US009314895B2

(12) United States Patent
Mori et al.

(10) Patent No.: US 9,314,895 B2
(45) Date of Patent: Apr. 19, 2016

(54) GRINDING APPARATUS

(71) Applicant: DISCO CORPORATION, Tokyo (JP)

(72) Inventors: Takashi Mori, Tokyo (JP); Shinichi Namioka, Tokyo (JP); Masaaki Nagashima, Tokyo (JP); Hidetaka Ochi, Tokyo (JP); Naoto Takata, Tokyo (JP); Masaaki Suzuki, Tokyo (JP); Hirotoshi Hoshikawa, Tokyo (JP); Osamu Miura, Tokyo (JP); Noriko Ito, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 14/560,017

(22) Filed: Dec. 4, 2014

(65) Prior Publication Data

US 2015/0158137 A1 Jun. 11, 2015

(30) Foreign Application Priority Data

Dec. 10, 2013 (JP) ..... 2013-255149

(51) Int. Cl.
*B24B 7/22* (2006.01)
*B24B 41/00* (2006.01)
*B24B 57/02* (2006.01)

(52) U.S. Cl.
CPC ..... *B24B 7/228* (2013.01); *B24B 41/005* (2013.01); *B24B 57/02* (2013.01)

(58) Field of Classification Search
CPC ..... B24B 37/345; B24B 37/30; B24B 37/24; B24B 7/228; B24B 41/005; B24B 57/02; B24B 21/04
USPC ..... 451/5, 11, 57, 65, 66, 73, 285–290
See application file for complete search history.

(56) References Cited

U.S. PATENT DOCUMENTS

| | | | | |
|---|---|---|---|---|
| 5,433,574 | A * | 7/1995 | Kawano | B01L 1/04 414/217 |
| 6,116,994 | A * | 9/2000 | Ito | B24B 37/345 451/288 |
| 6,309,279 | B1 * | 10/2001 | Bowman | B24B 37/345 451/288 |
| 6,354,922 | B1 * | 3/2002 | Sakurai | B24B 37/042 257/E21.23 |
| 6,358,128 | B1 * | 3/2002 | Sakurai | B24B 37/042 257/E21.23 |
| 6,413,154 | B1 * | 7/2002 | Togawa | B24B 37/04 451/285 |
| 6,595,831 | B1 * | 7/2003 | Hirokawa | B08B 1/04 451/36 |
| 2002/0005161 | A1 * | 1/2002 | Sasayama | B23Q 11/085 117/200 |

(Continued)

FOREIGN PATENT DOCUMENTS

JP 2003-300155 10/2003

*Primary Examiner* — George Nguyen
(74) *Attorney, Agent, or Firm* — Greer Burns & Crain, Ltd.

(57) ABSTRACT

A grinding apparatus for grinding a wafer stored in a cassette composed of a container for storing the wafer and a lid for enclosing the container. The grinding apparatus includes a cassette table for placing the cassette thereon, a lid removing unit for removing the lid from the cassette placed on the cassette table and leaving only the container on the cassette table, a chuck table for holding the wafer under suction, a chuck table moving unit for moving the chuck table to a grinding area, a grinding unit provided in the grinding area, the grinding unit having a grinding wheel for grinding the wafer held on the chuck table, a grinding water supplying unit for supplying a grinding water to abrasive members of the grinding wheel, and a waste water collecting unit for collecting waste water generated in grinding the wafer by operating the grinding unit.

10 Claims, 13 Drawing Sheets

(56) References Cited

U.S. PATENT DOCUMENTS

2003/0133762 A1* 7/2003 Yamamoto ..... H01L 21/67132 406/198
2003/0232581 A1* 12/2003 Ki ..... B24B 51/00 451/64
2008/0254714 A1* 10/2008 Torikoshi ..... B24B 37/042 451/5
2009/0084785 A1* 4/2009 Nakatogawa ..... H01L 21/67373 220/212.5
2009/0247056 A1* 10/2009 Masuda ..... B24B 7/228 451/54
2011/0165823 A1* 7/2011 Ide ..... B24B 37/00 451/41
2012/0315831 A1* 12/2012 Takada ..... C11D 7/5013 451/73

* cited by examiner

GRINDING APPARATUS

BACKGROUND OF THE INVENTION

1. Field of the Invention

The present invention relates to a grinding apparatus for grinding a wafer such as a semiconductor wafer.

2. Description of the Related Art

In a semiconductor device fabrication process, a plurality of crossing division lines are formed on the front side of a substantially disk-shaped semiconductor wafer to define a plurality of separate regions where a plurality of semiconductor devices such as ICs and LSIs are respectively formed. The semiconductor wafer is cut along the division lines to divide the regions where the semiconductor devices are formed from each other, thereby obtaining the individual semiconductor devices as chips. For the purpose of reducing the size and weight of each semiconductor device, the back side of the semiconductor wafer is ground by using a grinding apparatus to reduce the thickness of the wafer to a desired thickness prior to cutting the wafer along the division lines to obtain the individual semiconductor devices.

The grinding apparatus for grinding the back side of the wafer includes a chuck table having a holding surface for holding the wafer, grinding means for grinding the wafer held on the chuck table, cleaning means for cleaning the wafer ground by the grinding means, a cassette table for placing a cassette storing a plurality of wafers, handling means for taking any selected one of the plural wafers out of the cassette placed on the cassette table, temporary setting means for temporarily setting the wafer taken out of the cassette by the handling means, first transfer means for transferring the wafer from the temporary setting means to the chuck table, and second transfer means for transferring the wafer from the chuck table to the cleaning means after grinding (see Japanese Patent Laid-open No. 2003-300155, for example).

SUMMARY OF THE INVENTION

In recent years, the diameter of the wafer tends to become as large as 300 mm or 450 mm, so as to improve the productivity in the manufacture of the semiconductor devices. Accordingly, the grinding apparatus mentioned above has also been improved in response to such an increase in wafer diameter. On the other hand, there has been proposed a system responding to flexible production as moving against the trend toward such an increase in wafer diameter, and it is desired to develop an apparatus for forming about one to four devices on a silicon wafer having a diameter of about 13 mm.

It is therefore an object of the present invention to provide a grinding apparatus which can automatically grind a wafer having a small diameter.

In accordance with an aspect of the present invention, there is provided a grinding apparatus for grinding a wafer stored in a cassette composed of a container for storing the wafer and a lid for enclosing the container, the grinding apparatus including a cassette table for placing the cassette thereon; lid removing means for removing the lid from the cassette placed on the cassette table and leaving only the container on the cassette table; cassette table elevating means for vertically moving the cassette table; wafer transfer means for transferring the wafer from the container left on the cassette table lowered by the cassette table elevating means; a temporary setting table for temporarily setting the wafer transferred by the wafer transfer means; wafer inverting means for inverting the wafer temporarily set on the temporary setting table; a chuck table for receiving the wafer inverted by the wafer inverting means in a wafer standby area and holding the wafer under suction; chuck table moving means for moving the chuck table from the wafer standby area to a grinding area; grinding means provided in the grinding area for grinding the wafer held on the chuck table, the grinding means having a grinding wheel composed of a wheel base and a plurality of abrasive members annularly mounted on the wheel base; grinding water supplying means having a water source for supplying a grinding water to the abrasive members of the grinding wheel; waste water collecting means for collecting a waste water generated in grinding the wafer by operating the grinding means as supplying the grinding water by operating the grinding water supplying means; and cleaning means for cleaning the wafer held on the chuck table after grinding.

Preferably, the cleaning means includes a dome for covering the wafer held on the chuck table, dome elevating means for vertically moving the dome, and a cleaning water nozzle provided inside the dome for spraying a cleaning water toward the wafer.

Preferably, the grinding apparatus further includes cleaning water supplying means having a water source for supplying the cleaning water to the cleaning means and air supplying means having an air source for supplying air to the cleaning means, wherein the cleaning water supplied by the cleaning water supplying means is mixed with the air supplied by the air supplying means to form a two-fluid mixture, which is sprayed from the cleaning water nozzle.

In this case, after cleaning the wafer held on the chuck table, the cleaning means functions to dry the wafer by stopping the operation of the cleaning water supplying means and operating only the air supplying means to thereby spray only the air from the cleaning water nozzle toward the wafer.

Preferably, the water source of the grinding water supplying means and the water source of the cleaning water supplying means are provided by a common water tank; the grinding apparatus further including pure water generating means for purifying the waste water collected by the waste water collecting means to generate a pure water and then returning the pure water to the water tank.

Preferably, the pure water generating means includes a filter for filtering the waste water to generate a fresh water, a ceramic filter for filtering the fresh water, ultraviolet light applying means for sterilizing the fresh water filtered by the ceramic filter, an ion exchange resin for removing ions from the fresh water sterilized by the ultraviolet light applying means to thereby generate an almost pure water, and an ultrafilter for filtering the almost pure water to obtain the pure water, which is then returned to the water tank.

Preferably, the grinding water supplying means includes a grinding water nozzle provided adjacent to the chuck table set in the grinding area for spraying the grinding water toward the abrasive members at a position spaced apart from the wafer held on the chuck table.

Preferably, the grinding means includes a spindle, a motor for rotationally driving the spindle, a housing for rotatably supporting the spindle, a mounter mounted to the spindle for mounting the grinding wheel thereon, a fastening nut for fixing the grinding wheel to the mounter, and chuck means for mounting the mounter to the spindle; the mounter including a flange portion having an upper surface to be mounted to the spindle and a lower surface for supporting the wheel base of the grinding wheel, a boss portion projecting from the lower surface of the flange portion at its central portion, the boss portion having an external thread on the outer circumference and being insertable through an opening formed at a central portion of the wheel base, and a shank projecting from the upper surface of the flange portion at its central portion;

whereby the boss portion of the mounter is inserted through the opening of the wheel base, and the fastening nut is next threadedly engaged with the external thread of the boss portion to thereby fix the wheel base to the lower surface of the flange portion of the mounter, and the shank of the mounter is next chucked by the chuck means to thereby mount the mounter to the spindle.

Preferably, the grinding apparatus further includes thickness detecting means for detecting the thickness of the wafer held on the chuck table.

Preferably, the lid of the cassette is provided with a first magnet, and the container of the cassette is provided with a ferromagnetic member adapted to be magnetically attached to the first magnet, whereby the first magnet is magnetically attached to the ferromagnetic member to thereby define an enclosed space in the cassette shielded from the outside air; the lid removing means including a lid periphery support member for supporting the periphery of the lid so as to surround the upper portion of the cassette table raised by the cassette table elevating means, a pressing unit for pressing the lid of the cassette placed on the cassette table, and a second magnet provided in the cassette table so as to be retractable from the upper surface of the cassette table for magnetically attracting the ferromagnetic member provided in the container of the cassette, the second magnet having a magnetic force larger than that of the first magnet; whereby when the cassette table is lowered by the cassette table elevating means, the ferromagnetic member provided in the container of the cassette placed on the cassette table is separated from the first magnet provided in the lid, and the container is lowered together with the cassette table by the magnetic attachment of the ferromagnetic member to the second magnet, so that the lid is left on the lid periphery support member and thereby removed from the cassette.

In the grinding apparatus described above, the wafer having a small diameter can be efficiently ground to reduce the thickness of the wafer to a desired thickness.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
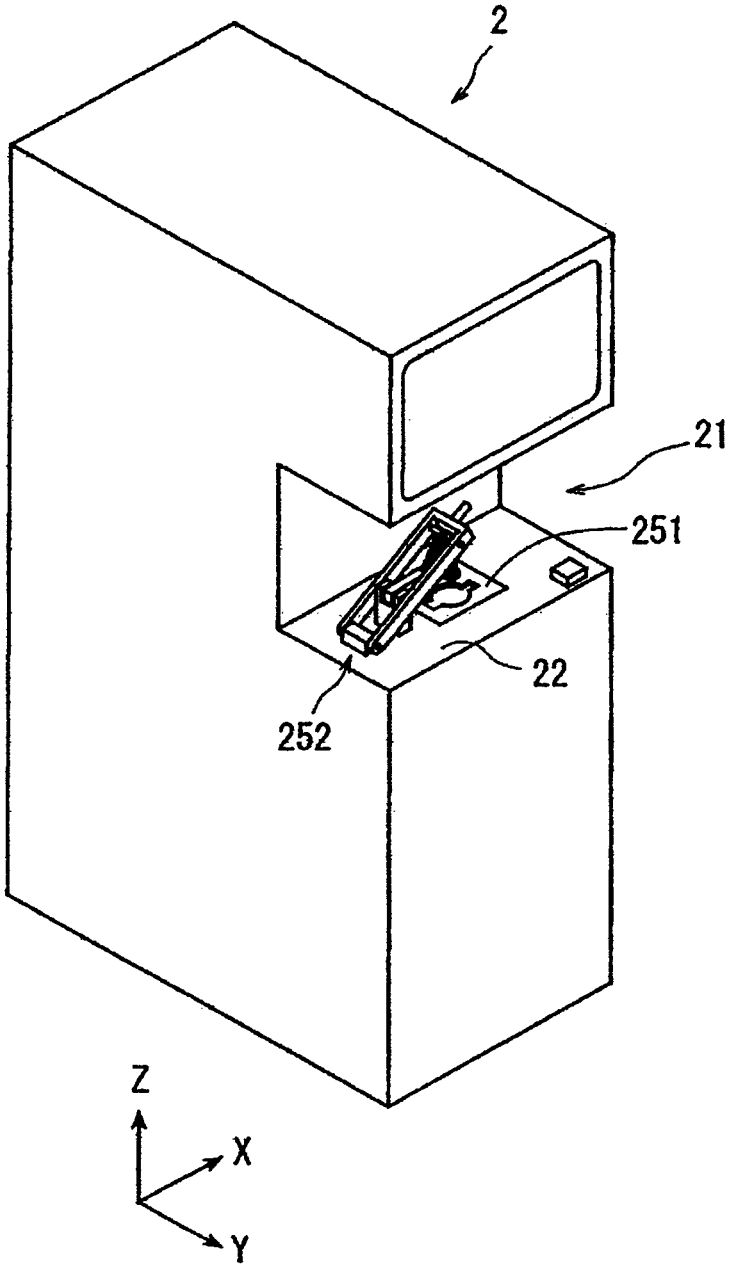
FIG. 1 is a perspective view of a grinding apparatus according to a preferred embodiment of the present invention.
Figure 2:
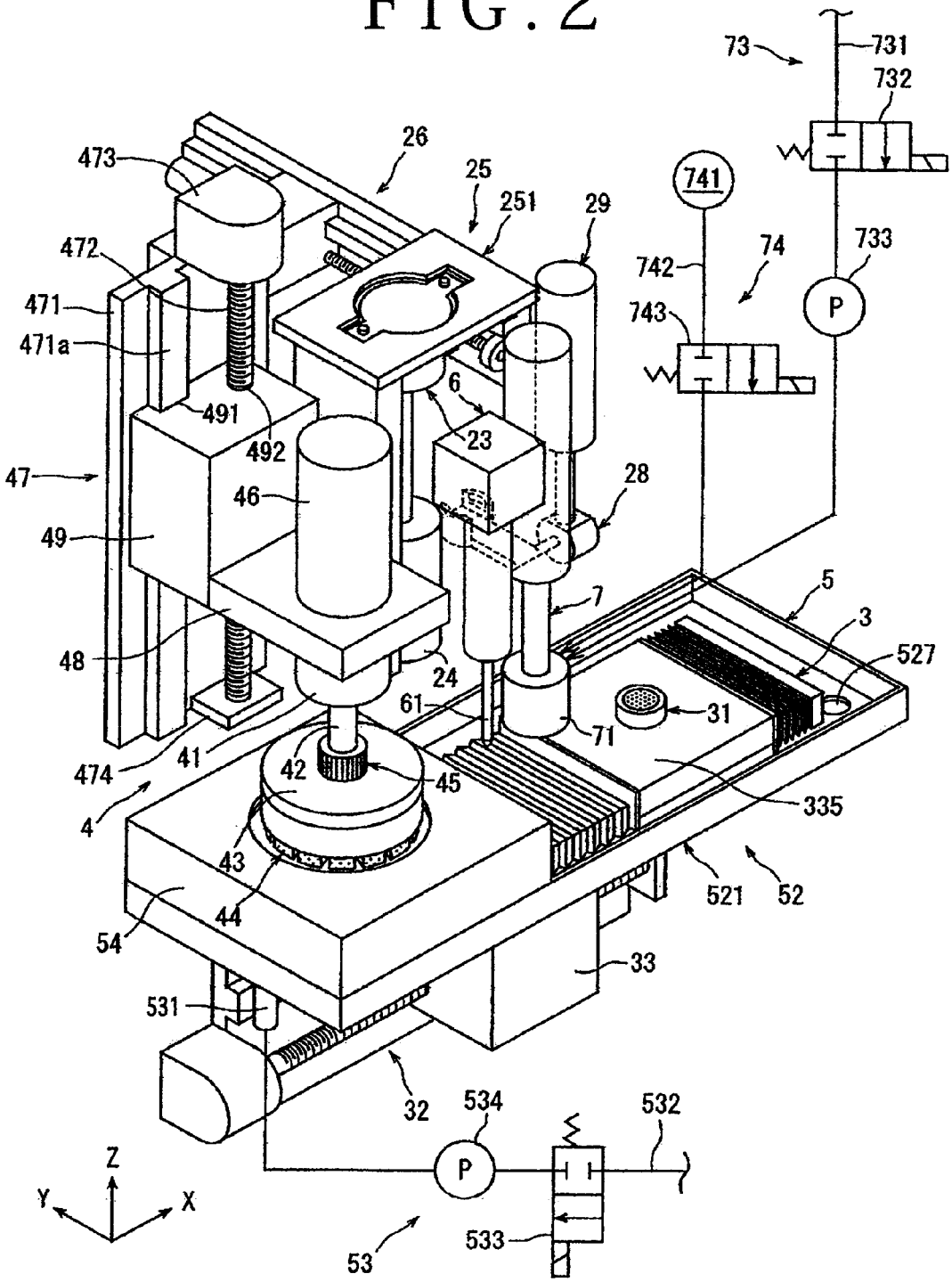
FIG. 2 is a perspective view of essential components provided in a unit housing constituting the grinding apparatus shown in FIG. 1 as viewed from the back side of the unit housing in the condition where a back door of the unit housing is open.

A preferred embodiment of the grinding apparatus according to the present invention will now be described in detail with reference to the attached drawings. FIG. 1 is a perspective view of a grinding apparatus according to this preferred embodiment, and FIG. 2 is a perspective view of essential components provided in a unit housing 2 constituting the grinding apparatus shown in FIG. 1 as viewed from the back side of the unit housing 2 in the condition where a back door (not shown) constituting the unit housing 2 is open. As shown in FIG. 1, the unit housing 2 of the grinding apparatus has a substantially boxlike shape. The front side of the unit housing 2 is formed with a wafer load/unload recess 21. The lower side of the wafer load/unload recess 21 as viewed in FIG. 1 is formed as a wafer load/unload table 22. The wafer load/unload table 22 is provided with a lid periphery support member 251 constituting lid removing means 25 which will be hereinafter described. A cassette 10 storing a wafer W to be hereinafter described (see FIGS. 3A and 3B) is adapted to be placed on the lid periphery support member 251. The unit housing 2 is so configured as to take in outside air through a filter (not shown). That is, the unit housing 2 serves as a clean room.

Figure 3A:
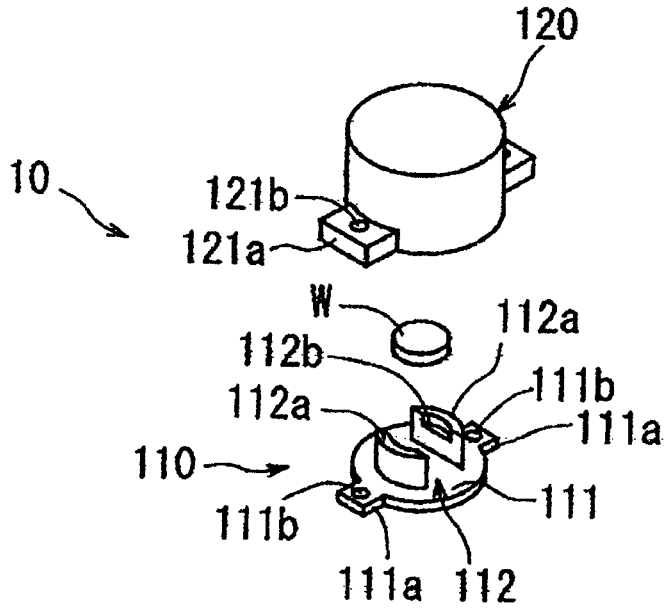
FIG. 3A is an exploded perspective view of a cassette for storing a wafer, the cassette being composed of a container and a lid.
Figure 3B:
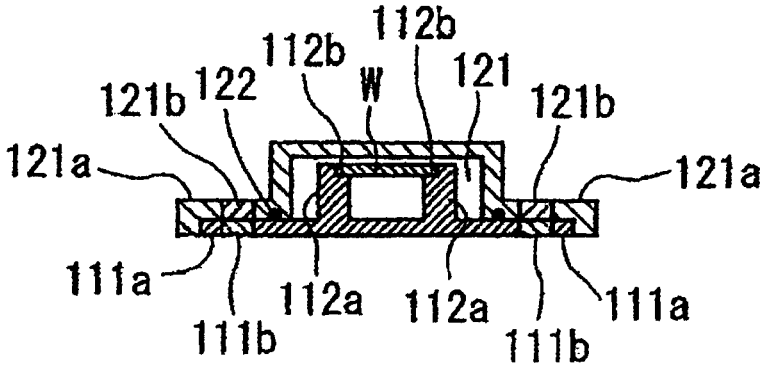
FIG. 3B is a sectional view of the cassette in the condition where the wafer is stored in the cassette.

The cassette 10 for storing the wafer W will now be described with reference to FIGS. 3A and 3B. The cassette 10 shown in FIGS. 3A and 3B is composed of a container 110 for containing the single wafer W and a lid 120 for enclosing the container 110. The container 110 is composed of a disk-shaped bottom plate 111 and wafer supporting means 112 formed on the upper surface of the bottom plate 111. The outer circumference of the bottom plate 111 is formed with a pair of ferromagnetic member mounting portions 111*a* at diametrically opposite positions. A pair of ferromagnetic pins 111*b* formed of iron or the like are mounted in the ferromagnetic member mounting portions 111*a*, respectively. The wafer supporting means 112 is composed of a pair of support members 112*a* opposed to each other with a predetermined spacing defined therebetween. The upper surfaces of the support members 112*a* are respectively formed with a pair of step portions 112*b* for placing the wafer W thereon. As shown in FIG. 3B, the wafer W is placed on the step portions 112*b* of the support members 112*a*. The wafer W is a silicon wafer having a small diameter (e.g., 13 mm), and it is placed on the step portions 112*b* in the condition where the front side of the wafer W is oriented upward.

Referring again to FIGS. 3A and 3B, the lid 120 constituting the cassette 10 is composed of an inverted cup-shaped (circular cylindrical) wafer storing portion 121 for storing the wafer supporting means 112 of the container 110 and a pair of magnet mounting portions 121*a* formed on the outer circumference of the lower end portion of the wafer storing portion 121 at diametrically opposite positions. The wafer storing portion 121 has an outer diameter larger than that of the bottom plate 111 of the container 110. The magnet mounting portions 121*a* of the lid 120 are so formed as to respectively engage the ferromagnetic member mounting portions 111*a* disposed on the periphery of the bottom plate 111 of the container 110. A pair of first permanent magnets 121*b* are respectively mounted in the magnet mounting portions 121*a* at positions corresponding to the ferromagnetic pins 111*b* mounted in the ferromagnetic member mounting portions 111*a* of the bottom plate 111 of the container 110. Further, a seal ring 122 is mounted on the lower end of the wafer storing portion 121 of the lid 120 as shown in FIG. 3B.

Accordingly, by engaging the magnet mounting portions 121*a* of the lid 120 with the ferromagnetic member mounting portions 111*a* of the container 110 as shown in FIG. 3B, the upper surfaces of the ferromagnetic pins 111*b* mounted in the ferromagnetic member mounting portions 111*a* of the container 110 respectively come into magnetic attachment to the lower surfaces of the first permanent magnets 121*b* mounted in the magnet mounting portions 121*a* of the lid 120, so that the container 110 and the lid 120 are united together to form the cassette 10. At this time, the seal ring 122 provided at the lower end of the wafer storing portion 121 of the lid 120 come into close contact with the upper surface of the bottom plate 111 of the container 110, so that an enclosed space isolated from the outside air is formed between the wafer storing portion 121 of the lid 120 and the bottom plate 111 of the container 110. In this manner, the wafer storing portion 121 for storing the wafer W in the cassette 10 is enclosed, and the unit housing 2 serves as a clean room as mentioned above. Accordingly, it is unnecessary to install the grinding apparatus in a clean room.

Referring back to FIG. 2, the grinding apparatus in this preferred embodiment includes a cassette table 23 for placing the cassette 10 thereon, cassette table elevating means 24 for vertically moving the cassette table 23, and lid removing means 25 for removing the lid 120 from the cassette 10 placed on the cassette table 23 and leaving only the container 110 on the cassette table 23. The cassette table 23, the cassette table elevating means 24, and the lid removing means 25 will now be described with reference to FIGS. 4A to 4C.

Figure 4A:
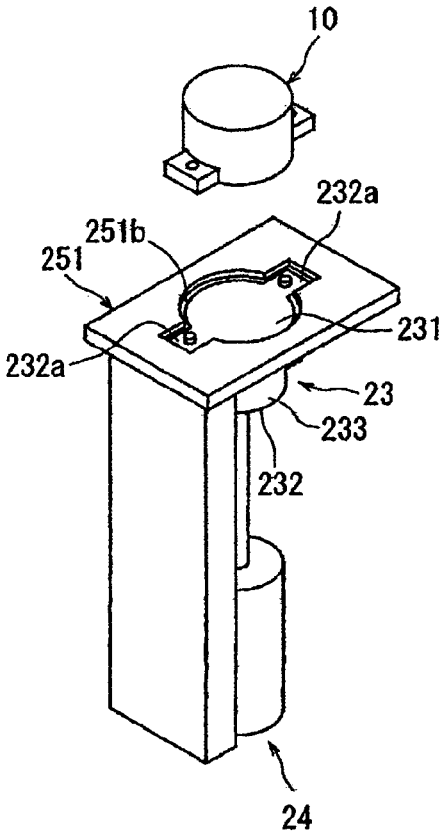
FIG. 4A is a perspective view showing a cassette table, cassette table elevating means, and a lid periphery support member of lid removing means constituting the grinding apparatus shown in FIG. 2.
Figure 4B:
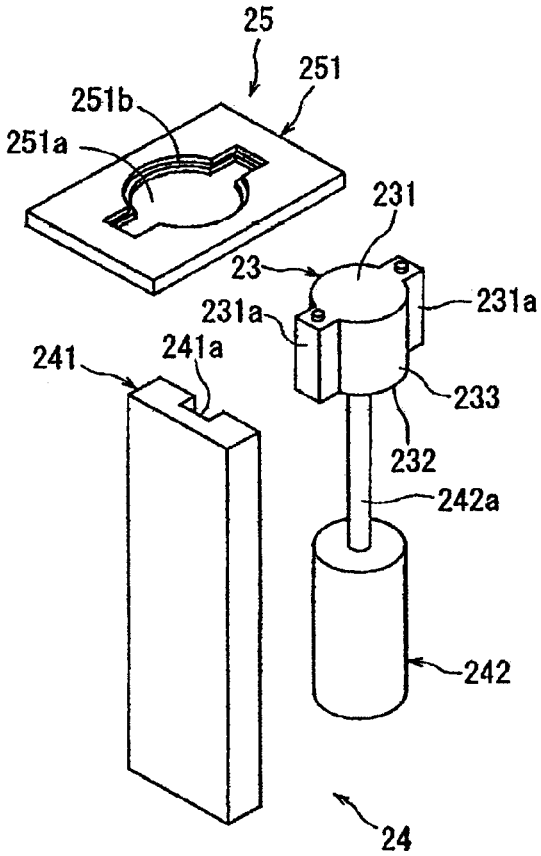
FIG. 4B is an exploded perspective view of the unit shown in FIG. 4A.

As shown in FIGS. 4A and 4B, the cassette table 23 is composed of a top wall 231 having a size corresponding to the size of the wafer storing portion 121 and the magnet mounting portions 121*a* of the lid 120 of the cassette 10 as viewed in plan, a bottom wall 232 having the same size as that of the top wall 231, and a side wall 233 connecting the outer circumference of the top wall 231 and the outer circumference of the bottom wall 232. A storing chamber 23*a* is defined by the top wall 231, the bottom wall 232, and the side wall 233 of the cassette table 23. The top wall 231 of the cassette table 23 is formed with a pair of magnet mounting portions 231*a* at positions corresponding to the ferromagnetic member mounting portions 111*a* disposed on the periphery of the bottom plate 111 of the container 110. The magnet mounting portions 231*a* of the top wall 231 are respectively formed with a pair of magnet insertion holes 231*b* at positions corresponding to the ferromagnetic pins 111*b* mounted in the ferromagnetic member mounting portions 111*a* of the container 110. A pair of second permanent magnets 231*c* are respectively inserted in the magnet insertion holes 231*b* of the top wall 231 so as to be axially movable in the magnet insertion holes 231*b*. The magnetic force of the second permanent magnets 231*c* is set to a value larger than the magnetic force of the first permanent magnets 121*b* mounted in the magnet mounting portions 121*a* of the lid 120.

The storing chamber 23*a* of the cassette table 23 is defined to store a support plate 234 on which the lower ends of the second permanent magnets 231*c* are mounted and an air cylinder 235 for vertically moving the support plate 234. The air cylinder 235 functions to vertically move the support plate 234 between a working position where the upper ends of the second permanent magnets 231*c* mounted on the support plate 234 are flush with the upper surface of the top wall 231 and a retracted position where the upper ends of the second permanent magnets 231*c* are retracted downward from the upper surface of the top wall 231.

The cassette table elevating means 24 is composed of a guide member 241 having a vertically extending guide groove 241*a* for slidably engaging one of the magnet mounting portions 231*a* of the cassette table 23 and an air cylinder 242 for moving the cassette table 23 along the guide groove 241*a* of the guide member 241. The air cylinder 242 has a piston rod 242*a* connected to the bottom wall 232 of the cassette table 23.

Figure 4C:
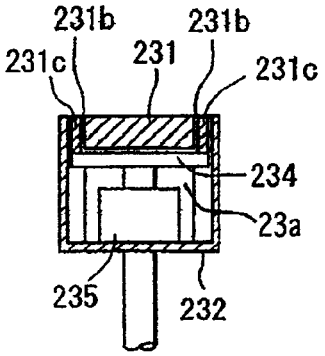
FIG. 4C is a sectional view of the cassette table shown in FIGS. 4A and 4B.

There will now be described with reference to FIGS. 4A and 4C and FIG. 5 the lid removing means 25 for removing the lid 120 from the cassette 10 placed on the cassette table 23 and leaving only the container 110 on the cassette table 23. The lid removing means 25 is composed of the lid periphery support member 251 for supporting the periphery of the lid 120 of the cassette 10, a pressing unit 252 for pressing the lid 120 of the cassette 10 placed on the lid periphery support member 251, and the second permanent magnets 231*c* provided in the cassette table 23. As shown in FIG. 1, the lid periphery support member 251 is provided on the wafer load/unload table 22 at a position directly above the cassette table 23 and is adapted to surround the upper portion of the cassette table 23 raised by the cassette table elevating means 24. Further, as shown in FIG. 1, the pressing unit 252 is provided on the wafer load/unload table 22 at a position adjacent to the lid periphery support member 251. The lid periphery support member 251 has an opening 251*a* having a size corresponding to that of the upper wall 231 of the cassette table 23. The opening 251*a* is surrounded by a support step 251*b* for supporting the periphery of the lower surface of the lid 120 of the cassette 10.

Figure 5:
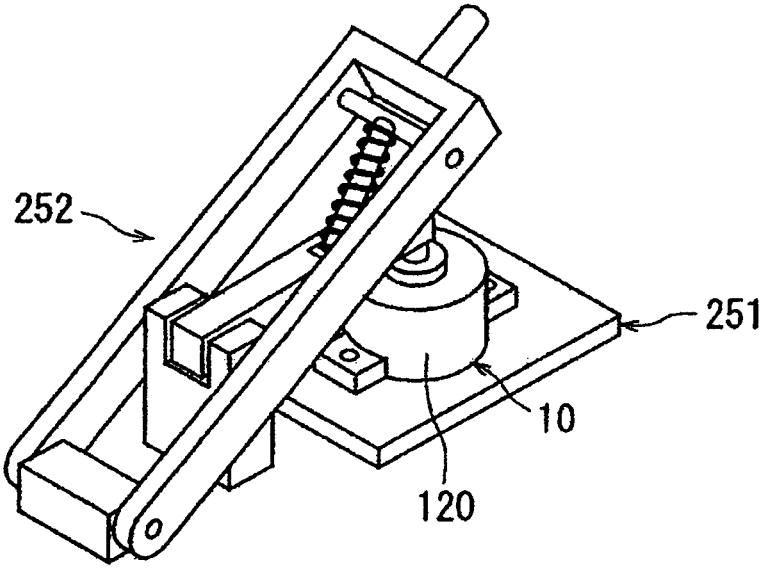
FIG. 5 is a perspective view showing a pressing unit of the lid removing means.
Figure 6A:
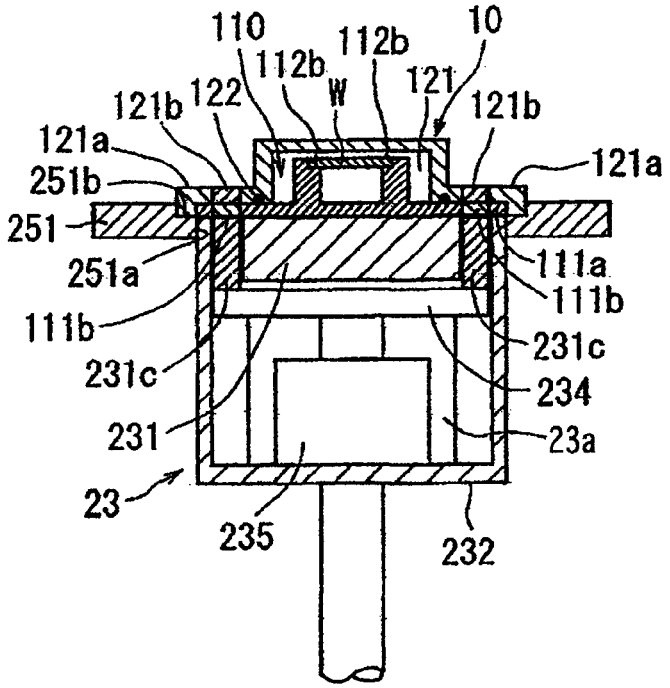
FIGS. 6A and 6B are sectional views for illustrating the operation of the lid removing means.

As shown in FIG. 5, the pressing unit 252 constituting the lid removing means 25 is provided by a known spring type pressing mechanism generally used in the art. The lid removing means 25 is operated in the following manner. First, the periphery of the lower surface of the lid 120 of the cassette 10 storing the wafer W as shown in FIG. 3B is placed on the support step 251*b* of the lid periphery support member 251. Thereafter, the pressing unit 252 is operated to press the lid 120 against the support step 251*b* of the lid periphery support member 251, thereby holding the lid 120 on the lid periphery support member 251. Further, as shown in FIG. 6A, the cassette table elevating means 24 is operated to raise the cassette table 23 so that the upper surface of the cassette table 23 comes into contact with the lower surface of the container 110 of the cassette 10. At this time, the upper end portion of the cassette table 23 is engaged with the opening 251*a* of the lid periphery support member 251. Accordingly, the inner peripheral surface forming the opening 251*a* of the lid periphery support member 251 surrounds the upper end portion of the cassette table 23 in the condition shown in FIG. 6A.

Figure 6B:
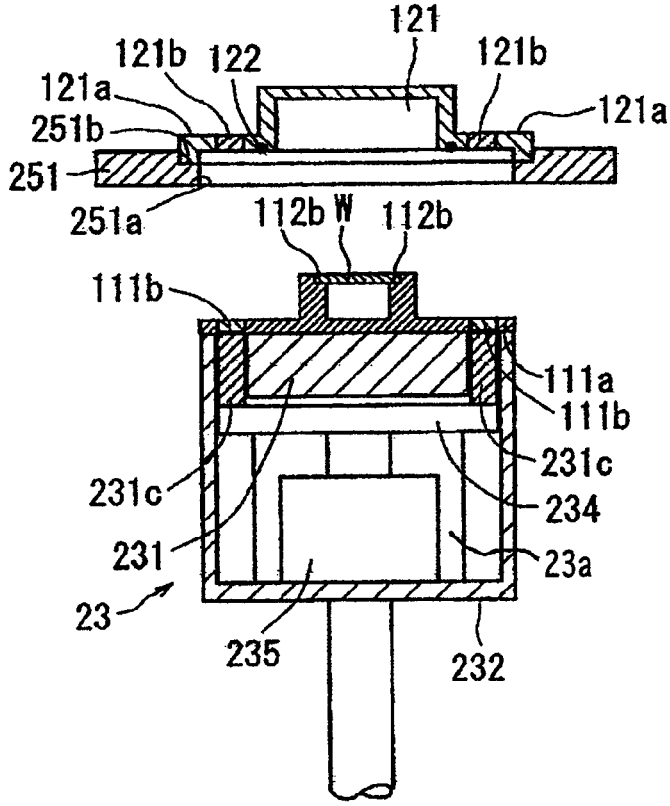

When the upper surface of the cassette table 23 is brought into contact with the lower surface of the container 110 of the cassette 10 as described above, the lower surfaces of the ferromagnetic pins 111*b* mounted in the container 110 of the cassette 10 are magnetically attached to the upper surfaces of the second permanent magnets 231*c* provided in the cassette table 23. Thereafter, as shown in FIG. 6B, the cassette table elevating means 24 is operated to lower the cassette table 23 by a predetermined amount. The magnetic force of the second permanent magnets 231*c* provided in the cassette table 23 is set to a value larger than the magnetic force of the first permanent magnets 121*b* mounted in the lid 120 of the cassette 10 as described above. Accordingly, the ferromagnetic pins 111*b* mounted in the container 110 are separated from the first permanent magnets 121*b* mounted in the lid 120, and only the container 110 is lowered to a predetermined position together with the cassette table 23 in the condition where the ferromagnetic pins 111*b* are magnetically attached to the second permanent magnets 231*c* provided in the cassette table 23. Accordingly, the lid 120 of the cassette 10 is held by the pressing unit 252 in the condition where the lid 120 closes the opening 251*a* of the lid periphery support member 251. That is, the unit housing 2 remains shielded from the outside air.

Figure 7:
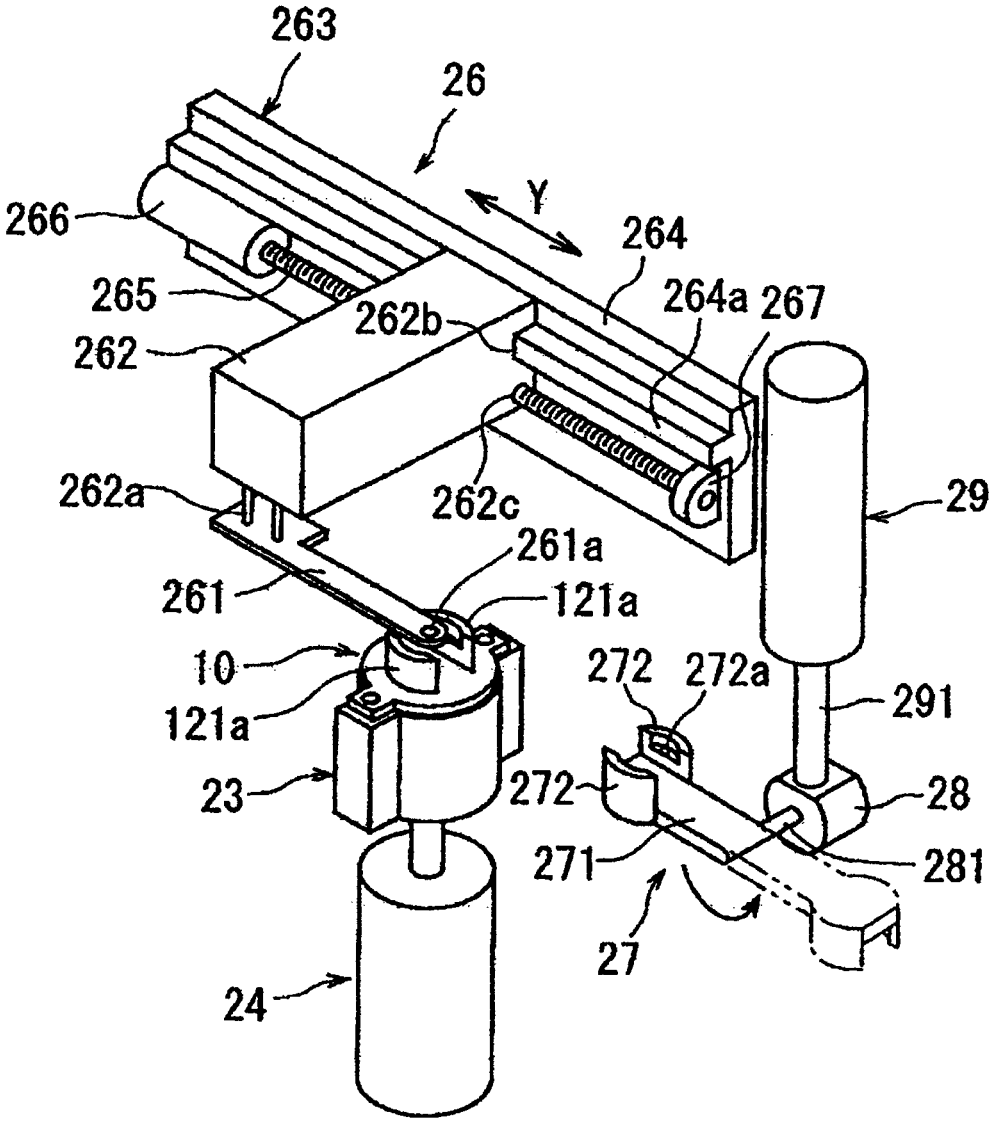
FIG. 7 is a perspective view showing wafer transfer means, a temporary setting table, and wafer inverting means constituting the grinding apparatus shown in FIG. 2.

Referring to FIGS. 2 and 7, the grinding apparatus in this preferred embodiment further includes wafer transfer means 26 for transferring the wafer W stored in the container 110 placed on the cassette table 23 lowered by the cassette table elevating means 24, a temporary setting table 27 for temporarily setting the wafer W transferred by the wafer transfer means 26, and wafer inverting means 28 for inverting the wafer W set on the temporary setting table 27.

As shown in FIG. 7, the wafer transfer means 26 is composed of a wafer holding member 261 adapted to be inserted between the pair of support members 112*a* formed on the bottom plate 111 of the container 110 placed on the cassette table 23, a moving block 262 supporting the base end portion of the wafer holding member 261, and Y-direction moving means 263 for moving the moving block 262 in the direction (Y direction) shown by an arrow Y in FIG. 7. The wafer holding member 261 is a hollow elongated platelike member, and a suction hole 261*a* is formed at the front end portion of the wafer holding member 261 so as to open to the upper surface thereof. This suction hole 261*a* is in communication with suction means (not shown). The moving block 262 supports the base end portion of the wafer holding member 261 through vertically movable supporting means 262*a*. That is, the wafer holding member 261 is vertically movably supported through the supporting means 262*a* to the moving block 262.

The moving block 262 has a guided groove 262*b* extending in the Y direction. The guided groove 262*b* is formed on one end of the moving block 262 so as to be opposed to the Y-direction moving means 263. The moving block 262 further has a tapped through hole 262*c* extending in the Y direction. The Y-direction moving means 263 is composed of a guide member 264 having a guide rail 264*a* slidably engaged with the guided groove 262*b* of the moving block 262 for guiding the moving block 262 in the Y direction, an externally threaded rod 265 provided along the guide rail 264*a* and threadedly engaged with the tapped through hole 262*c* of the moving block 262, a pulse motor 266 connected to one end of the externally threaded rod 265, and a bearing 267 provided on the guide member 264 for rotatably supporting the other end of the externally threaded rod 265. The Y-direction moving means 263 is operated in the following manner. When the pulse motor 266 is operated in one rotational direction or in the other rotational direction, the externally threaded rod 265 threadedly engaged with the tapped through hole 262*c* of the moving block 262 is rotated to thereby move the moving block 262 along the guide rail 264*a* in the Y direction. Accordingly, the wafer holding member 261 supported to the moving block 262 is also moved together in the Y direction.

Figure 8:
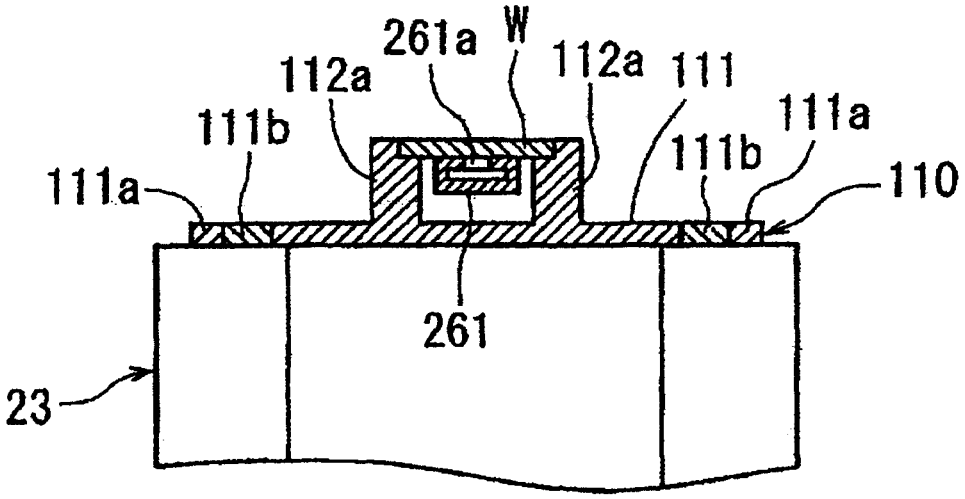
FIG. 8 is a sectional view for illustrating the relation between a wafer holding member constituting the wafer transfer means shown in FIG. 7 and the wafer stored in the container placed on the cassette table.

The wafer transfer means 26 is operated in the following manner. As shown in FIG. 8, the front end portion of the wafer holding member 261 is inserted between the pair of support members 112*a* formed on the bottom plate 111 of the container 110 placed on the cassette table 23 lowered by the cassette table elevating means 24, wherein the wafer W is placed on the support members 112*a*. Thereafter, the suction means (not shown) connected to the suction hole 261*a* of the wafer holding member 261 is operated to hold the back side (lower surface) of the wafer W on the upper surface of the wafer holding member 261 under suction. In the condition where the wafer W is held on the upper surface of the wafer holding member 261 under suction, the supporting means 262*a* of the moving block 262 is operated to raise the wafer holding member 261 to a position slightly higher than the upper ends of the support members 112*a*. Thereafter, the Y-direction moving means 263 is operated to transfer the wafer holding member 261 holding the wafer W to the temporary setting table 27 shown in FIG. 7.

The temporary setting table 27 will now be described with reference to FIG. 7. The temporary setting table 27 is composed of a base plate 271 and a pair of support members 272 formed on the opposite side surfaces of the base plate 271 at its front end portion. The upper surfaces of the support members 272 are respectively formed with a pair of step portions 272*a* for placing the wafer W thereon. Further, a pair of suction holes 272*b* are formed so as to respectively open to the step portions 272*a*. These suction holes 272*b* are in communication with suction means (not shown). The temporary setting table 27 is connected to the wafer inverting means 28 in such a manner that the base end of the base plate 271 of the temporary setting table 27 is connected to a rotating shaft 281 included in the wafer inverting means 28. The wafer inverting means 28 is provided by a known rotary operation mechanism such that the rotating shaft 281 is adapted to be rotated 180°. The wafer inverting means 28 is connected to a vertically movable piston rod 291 of an air cylinder 29.

Figure 9:
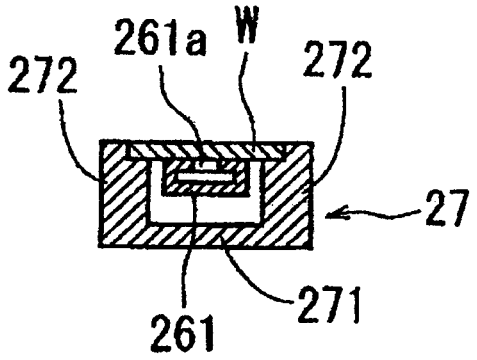
FIG. 9 is a sectional view showing the condition where the wafer has been transferred to the temporary setting table by the wafer holding member of the wafer transfer means shown in FIG. 7.

The operation of the temporary setting table 27 and the wafer inverting means 28 will now be described. The wafer W held under suction on the upper surface of the front end portion of the wafer holding member 261 of the wafer transfer means 26 is transferred to a position directly above the temporary setting table 27 by operating the Y-direction moving means 263, wherein the temporary setting table 27 is preliminarily set at a wafer receiving position shown by a solid line in FIG. 7. At this time, the cassette table elevating means 24 is operated to further lower the cassette table 23 in advance. Thereafter, the vertically movable supporting means 262*a* of the moving block 262 is operated to lower the wafer holding member 261 until the back side (lower surface) of the wafer W held under suction on the upper surface of the front end portion of the wafer holding member 261 of the wafer transfer means 26 is placed on the step portions 272*a* of the support members 272 of the temporary setting table 27 as shown in FIG. 9.

Thereafter, the suction holding by the wafer holding member 261 is canceled and the suction means connected to the temporary setting table 27 is next operated to hold the back side (lower surface) of the wafer W on the step portions 272*a* of the support members 272 of the temporary setting table 27 under suction. In the condition where the wafer W is held under suction by the support members 272 of the temporary setting table 27 as mentioned above, the wafer inverting means 28 is operated to 180° rotate the temporary setting table 27 to an inverted position shown by a phantom line in FIG. 7. As a result, the front side of the wafer W held by the support members 272 of the temporary setting table 27 is oriented downward. The wafer W held on the temporary setting table 27 in its inverted position is positioned directly above a chuck table 31 set at a wafer standby area shown in FIG. 2, which will be hereinafter described.

Referring back to FIG. 2, the grinding apparatus in this preferred embodiment further includes a chuck table mechanism 3 for receiving the wafer W inverted by the wafer inverting means 28 and holding the wafer W under suction. The chuck table mechanism 3 will now be described with reference to FIG. 2 and FIGS. 10A and 10B. The chuck table mechanism 3 includes a chuck table 31 for receiving the wafer W inverted by the wafer inverting means 28 and holding the wafer W under suction and chuck table moving means 32 for moving the chuck table 31 between the wafer standby area shown in FIG. 2 and a grinding area to be hereinafter described. The chuck table 31 has an upper surface provided with a vacuum chuck 311, which is formed of porous ceramics. The vacuum chuck 311 is in communication with suction means (not shown). By operating this suction means, the wafer W placed on the upper surface of the vacuum chuck 311 as a holding surface is held under suction.

Figures 10A, 10B:
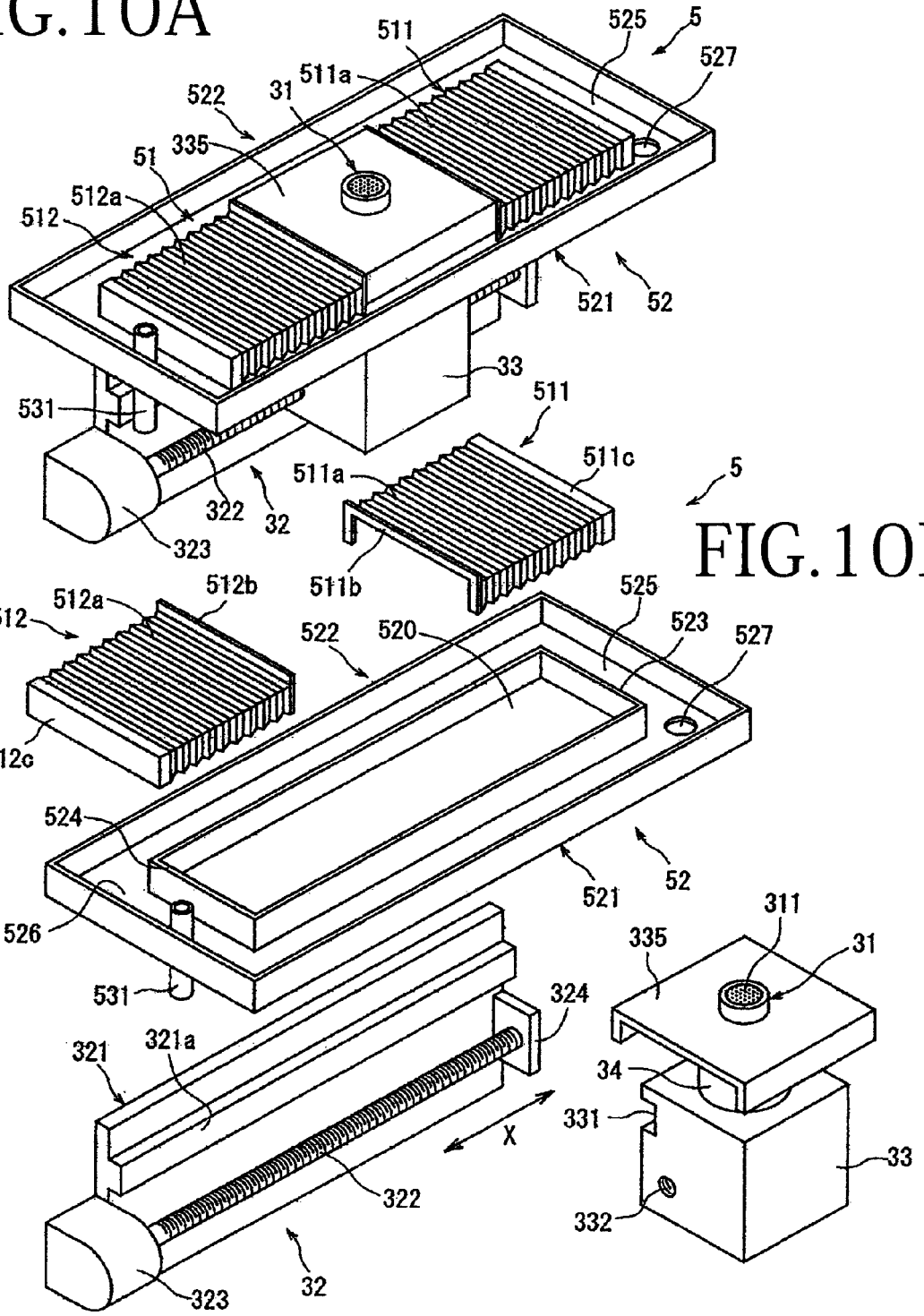
FIG. 10A is a perspective view of a chuck table mechanism and waste water collecting means constituting the grinding apparatus shown in FIG. 2.
FIG. 10B is an exploded perspective view of the unit shown in FIG. 10A.

The chuck table 31 is rotatably supported to a cylindrical member 34 provided on a chuck table supporting base 33. The chuck table 31 is adapted to be rotated by a servo motor (not shown) provided in the cylindrical member 34. As shown in FIGS. 10A and 10B, the chuck table supporting base 33 has a substantially boxlike shape, and a guided groove 331 is formed on one side surface of the chuck table supporting base 33 so as to extend in the direction (X direction perpendicular to the Y direction) shown by an arrow X in FIG. 10B. The chuck table supporting base 33 is further formed with a tapped through hole 332 extending parallel to the guided groove 331. Further, a waterproof cover 335 is provided on the upper end of the cylindrical member 34 and positioned below the upper surface of the chuck table 31 by a predetermined level.

Referring again to FIGS. 10A and 10B, the chuck table moving means 32 is composed of a guide member 321 having a guide rail 321*a* slidably engaged with the guided groove 331 of the chuck table supporting base 33 for guiding the chuck table supporting base 33 in the X direction, an externally threaded rod 322 provided along the guide rail 321*a* and threadedly engaged with the tapped through hole 332 of the chuck table supporting base 33, a pulse motor 323 connected to one end of the externally threaded rod 322, and a bearing 324 provided on the guide member 321 for rotatably supporting the other end of the externally threaded rod 322. The chuck table moving means 32 is operated in the following manner. When the pulse motor 323 is operated in one rotational direction or in the other rotational direction, the externally threaded rod 322 threadedly engaged with the tapped through hole 332 of the chuck table supporting base 33 is rotated to thereby move the chuck table supporting base 33 along the guide rail 321*a* in the X direction. Accordingly, the chuck table 31 supported through the cylindrical member 34 to the chuck table supporting base 33 is also moved together in the X direction.

Referring back to FIG. 2, the grinding apparatus in this preferred embodiment further includes grinding means 4 provided in the grinding area for grinding the wafer W held on the chuck table 31. The grinding means 4 will now be described with reference to FIG. 2 and FIG. 11. The grinding means 4 includes a cylindrical housing 41, a spindle 42 rotatably supported to the housing 41, a mounter 43 connected to the lower end of the spindle 42, a grinding wheel 44 mounted on the lower surface of the mounter 43, chuck means 45 for detachably mounting the mounter 43 with the grinding wheel 44 to the lower end of the spindle 42, and a servo motor 46 (see FIG. 2) provided on the upper end of the housing 41 for rotationally driving the spindle 42.

Figure 11:
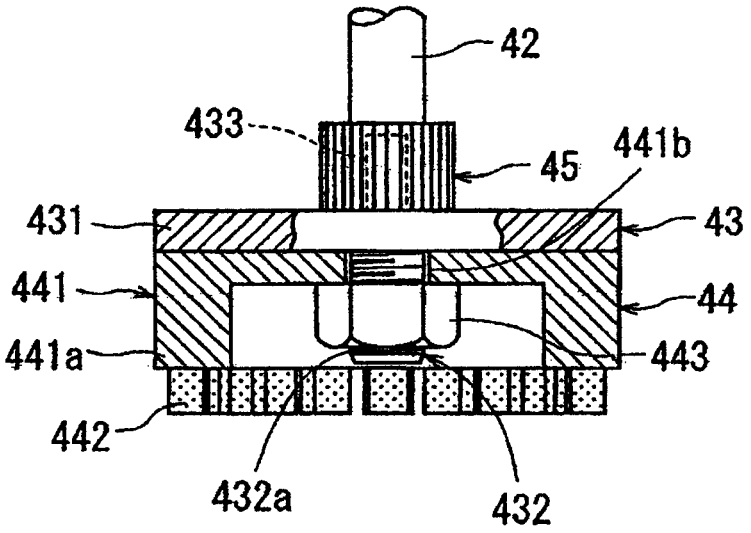
FIG. 11 is a partially sectional side view showing a spindle, a mounter, and a grinding wheel constituting grinding means provided in the grinding apparatus shown in FIG. 2.

As shown in FIG. 11, the mounter 43 constituting the grinding means 4 is composed of a disk-shaped flange portion 431, a boss portion 432 projecting from the lower surface of the flange portion 431 at its central portion, the boss portion 432 having an external thread 432*a* on the outer circumference, and a shank 433 projecting from the upper surface of the flange portion 431 at its central portion. The grinding wheel 44 is mounted on the lower surface of the mounter 43, and the shank 433 of the mounter 43 is next mounted to the spindle 42 by the chuck means 45.

Referring again to FIG. 11, the grinding wheel 44 mounted on the lower surface of the mounter 43 is composed of a wheel base 441 and a plurality of abrasive members 442 mounted on the lower surface of the wheel base 441. The wheel base 441 is formed with an annular abrasive mounting portion 441*a* projecting from the lower surface of the peripheral portion and a central opening 441*b* for receiving the boss portion 432 of the mounter 43. The grinding wheel 44 is mounted to the spindle 42 in the following manner. The boss portion 432 of the mounter 43 is inserted through the opening 441*b* of the wheel base 441, and a fastening nut 443 is threadedly engaged with the external thread 432*a* disposed on the periphery of the boss portion 432, thereby fixing the upper surface of the wheel base 441 of the grinding wheel 44 to the lower surface of the flange portion 431 of the mounter 43. Thereafter, the mounter 43 united with the grinding wheel 44 is mounted to the lower end of the spindle 42 in such a manner that the shank 433 of the mounter 43 is chucked by the chuck means 45 mounted on the lower end portion of the spindle 42.

Referring back to FIG. 2, the grinding means 4 further includes feeding means 47 for moving a spindle unit composed of the housing 41, the spindle 42, the mounter 43, the grinding wheel 44, the chuck means 45, and the servo motor 46 in the vertical direction (Z direction perpendicular to the X direction and the Y direction) shown by an arrow Z in FIG. 2 as a feeding direction. This feeding means 47 supports a moving base 49 so that the moving base 49 is movable in the Z direction, wherein a support member 48 for supporting the housing 41 is mounted on the moving base 49. The moving base 49 has a substantially boxlike shape, and a guided groove 491 is formed on one side surface of the moving base 49 so as to extend in the Z direction. The moving base 49 is further formed with a tapped through hole 492 extending parallel to the guided groove 491. The feeding means 47 supporting the moving base 49 so as to allow the movement of the moving base 49 in the Z direction is composed of a guide member 471 having a guide rail 471*a* slidably engaged with the guided groove 491 of the moving base 49 for guiding the moving base 49 in the Z direction, an externally threaded rod 472 provided along the guide rail 471*a* and threadedly engaged with the tapped through hole 492 of the moving base 49, a pulse motor 473 connected to one end of the externally threaded rod 472, and a bearing 474 provided on the guide member 471 for rotatably supporting the other end of the externally threaded rod 472. The feeding means 47 is operated in the following manner. When the pulse motor 473 is operated in one rotational direction or in the other rotational direction, the externally threaded rod 472 threadedly engaged with the tapped through hole 492 of the moving base 49 is rotated to thereby move the moving base 49 along the guide rail 471*a* in the Z direction (upward or downward). Accordingly, the spindle unit supported through the support member 48 to the moving base 49 is also moved together in the Z direction.

Referring back to FIG. 2, the grinding apparatus in this preferred embodiment further includes waste water collecting means 5 for collecting a waste water generated in grinding the wafer W held on the chuck table 31 by operating the grinding means 4 as supplying a grinding water to be hereinafter described. This waste water collecting means 5 will now be described with reference to FIG. 2 and FIGS. 10A and 10B. The waste water collecting means 5 in this preferred embodiment includes bellows means 51 for covering an area of movement of the chuck table 31 in the X direction and a waste water pan 52 for receiving the waste water. As shown in FIGS. 10A and 10B, the bellows means 51 includes first bellows means 511 and second bellows means 512 provided on the opposite sides of the chuck table 31 in the X direction, thereby covering the chuck table moving means 32 and its associated parts.

The first bellows means 511 is composed of a bellows member 511*a*, a first connecting member 511*b* mounted on one end of the bellows member 511*a*, and a second connecting member 511*c* mounted on the other end of the bellows member 511*a*. The bellows member 511*a* is formed from a foldable sheet member like a cloth such that a plurality of ridges and grooves are alternately formed so as to be expansible and contractable. Each of the first and second connecting members 511*b* and 511*c* may be formed from a metal plate. The first connecting member 511*b* mounted on one end of the bellows member 511*a* of the first bellows means 511 is connected to the waterproof cover 335 adapted to move with the chuck table 31. The second connecting member 511*c* mounted on the other end of the bellows member 511*a* is connected to an end wall of the waste water pan 52, which will be hereinafter described.

As similar to the first bellows means 511, the second bellows means 512 is composed of a bellows member 512*a*, a first connecting member 512*b* mounted on one end of the bellows member 512*a*, and a second connecting member 512*c* mounted on the other end of the bellows member 512*a*. The bellows member 512*a* is formed from a foldable sheet member like a cloth such that a plurality of ridges and grooves are alternately formed so as to be expansible and contractable. Each of the first and second connecting members 512*b* and 512*c* may be formed from a metal plate. The first connecting member 512*b* mounted on one end of the bellows member 512*a* is connected to the waterproof cover 335 adapted to move with the chuck table 31. The second connecting member 512*c* mounted on the other end of the bellows member 512*a* is connected to the other end wall of the waste water pan 52, which will be hereinafter described.

The waste water pan 52 functions also as guiding means for guiding the expansion and contraction of the first bellows means 511 and the second bellows means 512. That is, as shown in FIG. 10B, the waste water pan 52 includes an opening 520 for allowing the movement of the chuck table 31 in the X direction, a first gutter 521 extending in the X direction adjacent to one side of the opening 520, a second gutter 522 extending in the X direction adjacent to the other side of the opening 520, a first end wall 523 provided at one end of the opening 520 in the X direction, and a second end wall 524 provided at the other end of the opening 520 in the X direction. The second connecting member 511*c* of the first bellows means 511 is connected to the first end wall 523 of the waste water pan 52 by means of fastening bolts (not shown). Similarly, the second connecting member 512*c* of the second bellows means 512 is connected to the second end wall 524 of the waste water pan 52 by means of fastening bolts (not shown). Further, a first communication gutter 525 is provided outside the first end wall 523, and a second communication gutter 526 is provided outside the second end wall 524. The first and second gutters 521 and 522 are in communication with each other through the first and second communication gutters 525 and 526. A drain hole 527 is formed at a position between the first communication gutter 525 and the first gutter 521. This drain hole 527 is connected to pure water generating means which will be hereinafter described.

Referring again to FIG. 2 and FIGS. 10A and 10B, the second communication gutter 526 of the waste water pan 52 is provided with a grinding water nozzle 531 for spraying a grinding water toward the lower surfaces (grinding surfaces) of the abrasive members 442 constituting the grinding wheel 44 of the grinding means 4. As shown in FIG. 2, the grinding water nozzle 531 is connected to grinding water supplying means 53. The grinding water supplying means 53 is composed of a pure water tank (not shown) for storing a pure water generated by pure water generating means to be hereinafter described, a grinding water pipe 532 for connecting the pure water tank and the grinding water nozzle 531, an electromagnetic on-off valve 533 provided in the grinding water pipe 532, and a grinding water pump 534 provided in the grinding water pipe 532 downstream of the electromagnetic on-off valve 533.

Figure 12:
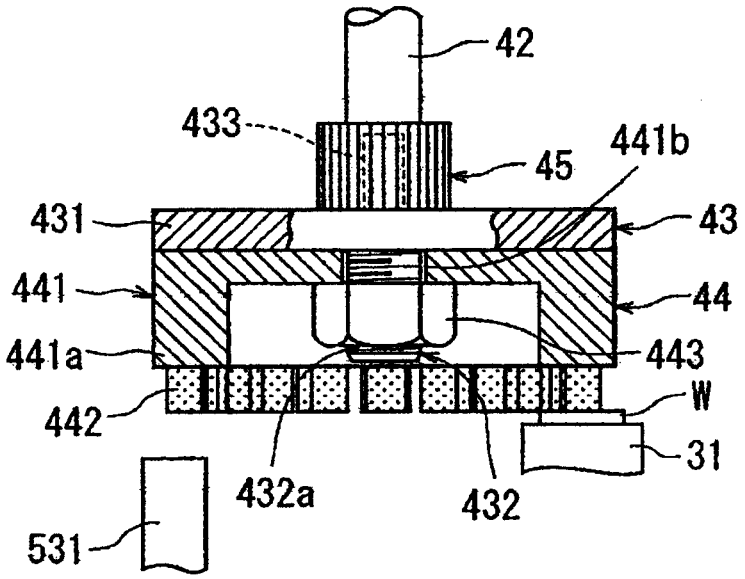
FIG. 12 is a partially sectional side view showing the relation between the grinding wheel shown in FIG. 11 and a grinding water nozzle.

The relation between the abrasive members 442 of the grinding wheel 44 and the grinding water nozzle 531 will now be described with reference to FIG. 12. As shown in FIG. 12, the chuck table 31 holding the wafer W is set in the grinding area where the grinding wheel 44 is located. The grinding water nozzle 531 is opposed to the abrasive members 442 of the grinding wheel 44 at a position spaced apart from the wafer W held on the chuck table 31 set in the grinding area. Accordingly, the grinding water nozzle 531 functions to spray a grinding water toward the lower surfaces of the abrasive members 442. The grinding water sprayed onto the abrasive members 442 opposed to the grinding water nozzle 531 is rotated with the abrasive members 442 to reach a grinding position where the wafer W is to be ground.

Referring back to FIG. 2, a wheel cover 54 for covering the abrasive members 442 of the grinding wheel 44 is detachably provided on the waste water collecting means 5 in the grinding area where the grinding wheel 44 of the grinding means 4 is located. The wheel cover 54 is a boxlike member designed to prevent the scattering of the grinding water, and one side surface of the wheel cover 54 is open to allow the pass of the chuck table 31 to the grinding area.

Referring again to FIG. 2, the grinding apparatus in this preferred embodiment further includes thickness detecting means 6 provided in a thickness detection area between the wafer standby area and the grinding area for detecting the thickness of wafer W held on the chuck table 31. The thickness detecting means 6 has a contactor 61 adapted to come into contact with the chuck table 31 and the wafer W held thereon. That is, the lower end of the contactor 61 is brought into contact with the upper surface of the chuck table 31 and the upper surface of the wafer W held on the chuck table 31, thereby measuring a difference in level between the upper surface of the chuck table 31 and the upper surface of the wafer W and then detecting the thickness of the wafer W according to this difference in level. As another type of thickness detecting means, thickness detecting means using an optical system or ultrasonic wave may be used.

Figure 13:
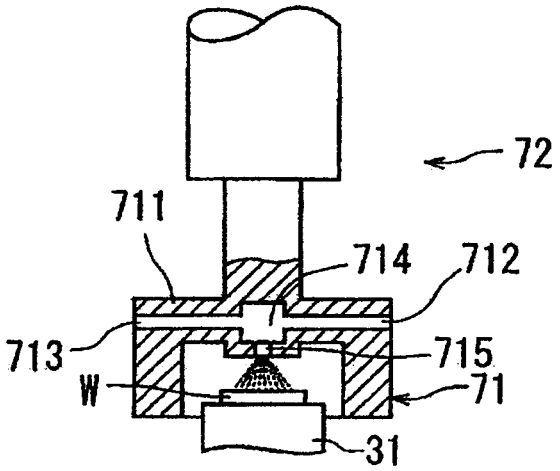
FIG. 13 is a partially sectional side view showing an essential part of cleaning means constituting the grinding apparatus shown in FIG. 2.

The grinding apparatus in this preferred embodiment further includes cleaning means 7 provided in a cleaning area between the wafer standby area and the thickness detection area for cleaning the wafer W held on the chuck table 31 after grinding. The cleaning means 7 will now be described with reference to FIG. 2 and FIG. 13. As shown in FIG. 13, the cleaning means 7 includes a dome member 71 for covering the wafer W held on the chuck table 31 positioned in the cleaning area and an air cylinder 72 for vertically moving the dome member 71 in the Z direction. The dome member 71 has a top wall 711, which is formed with a cleaning water passage 712, an air passage 713, and a mixing chamber 714 communicating with the cleaning water passage 712 and the air passage 713. The central portion of the top wall 711 is formed with a cleaning water nozzle 715 communicating with the mixing chamber 714 for downward spraying a cleaning water mixed with air toward the wafer W.

The cleaning water passage 712 of the dome member 71 constituting the cleaning means 7 is connected to cleaning water supplying means 73 shown in FIG. 2, whereas the air passage 713 of the dome member 71 is connected to air supplying means 74 shown in FIG. 2. As shown in FIG. 2, the cleaning water supplying means 73 is composed of a cleaning water pipe 731 for connecting a pure water tank to be hereinafter described and the cleaning water passage 712 of the dome member 71, an electromagnetic on-off valve 732 provided in the cleaning water pipe 731, and a cleaning water pump 733 provided in the cleaning water pipe 731 downstream of the electromagnetic on-off valve 732. The air supplying means 74 is composed of an air source 741, an air pipe 742 for connecting the air source 741 and the air passage 713 of the dome member 71, and an electromagnetic on-off valve 743 provided in the air pipe 742.

The cleaning means 7 is operated in the following manner. When the chuck table 31 holding the wafer W ground by the grinding means 4 is positioned in the cleaning area, the air cylinder 72 is operated to lower the dome member 71, thereby covering the wafer W held on the chuck table 31 as shown in FIG. 13. Thereafter, the cleaning water supplying means 73 and the air supplying means 74 are operated to supply a cleaning water and air to the mixing chamber 714, thereby mixing the cleaning water and the air in the mixing chamber 714. Accordingly, the mixture of the cleaning water and the air as two fluids is sprayed from the cleaning water nozzle 715 toward the wafer W held on the chuck table 31 after grinding, thereby cleaning the wafer W. After cleaning the wafer W, the operation of the cleaning water supplying means 73 is stopped and only the air supplying means 74 remains operated to spray only the air from the cleaning water nozzle 715 toward the wafer W, thereby drying the wafer W.

Figure 14:
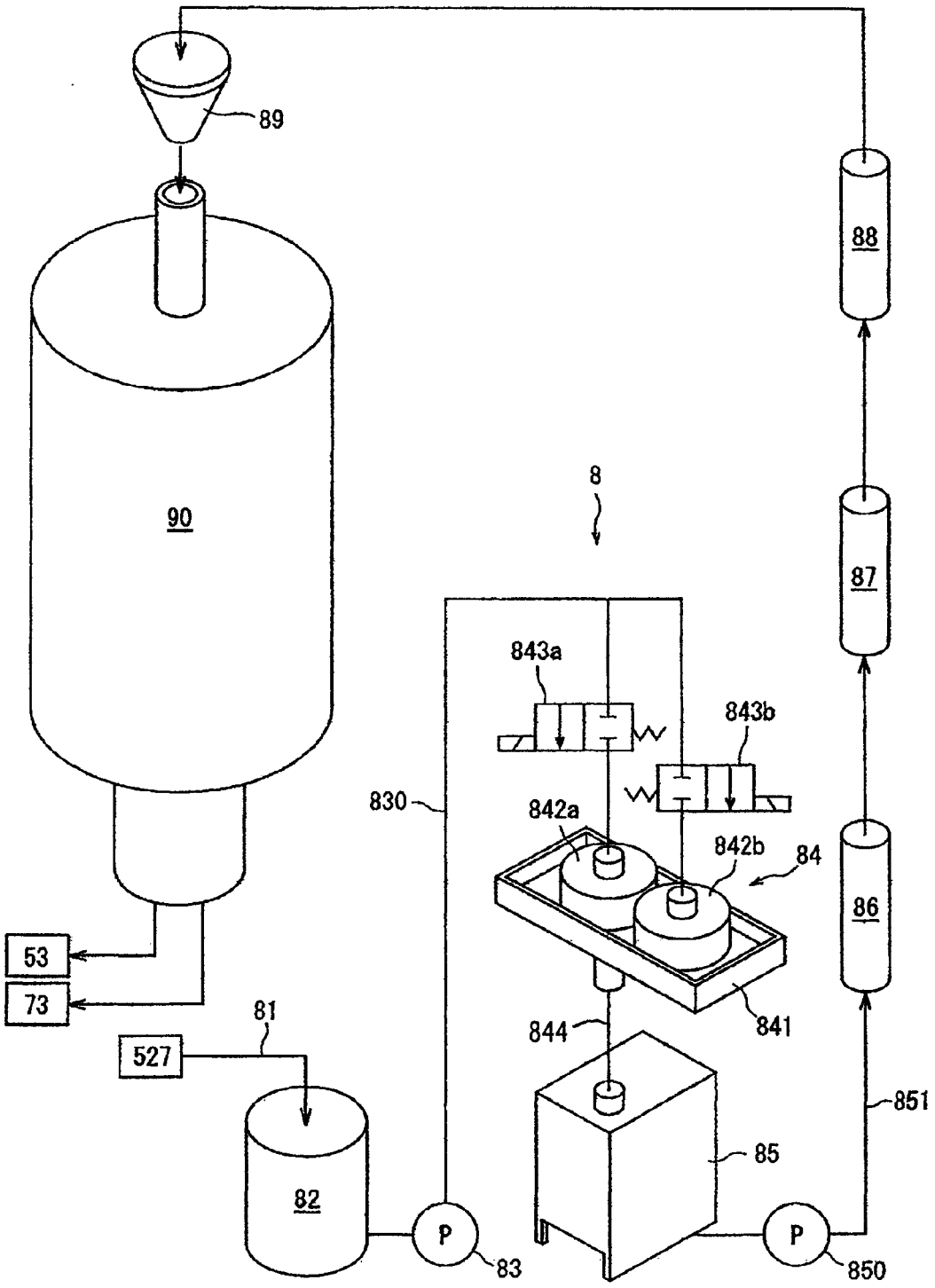
FIG. 14 is a schematic diagram for illustrating pure water generating means and a pure water tank included in the grinding apparatus shown in FIG. 2.

The grinding apparatus in this preferred embodiment further includes pure water generating means 8 (see FIG. 14) for purifying a waste water collected by the waste water collecting means 5 to generate a pure water. This pure water generating means 8 will now be described with reference to FIG. 14. The pure water generating means 8 shown in FIG. 14 includes a waste water tank 82 connected through a pipe 81 to the drain hole 527 of the waste water collecting means 5 for storing a waste water and a waste water pump 83 for sending the waste water stored in the waste water tank 82.

The waste water stored in the waste water tank 82 is sent by the waste water pump 83 through a pipe 830 such as a flexible hose to waste water filtering means 84. The waste water filtering means 84 includes a fresh water pan 841 and first and second filters 842*a* and 842*b* provided on the fresh water pan 841. The first and second filters 842*a* and 842*b* are detachably provided on the fresh water pan 841. The pipe 830 for connecting the waste water pump 83 to the first and second filters 842*a* and 842*b* is provided with electromagnetic on-off valves 843*a* and 843*b*. When the electromagnetic on-off valve 843*a* becomes ON to open, the waste water sent by the waste water pump 83 is introduced into the first filter 842*a*, whereas when the electromagnetic on-off valve 843*b* becomes ON to open, the waste water sent by the waste water pump 83 is introduced into the second filter 842*b*.

The waste water introduced into the first or second filter 842*a* or 842*b* is filtered by the first or second filter 842*a* or 842*b* to remove sludge mixed in the waste water, thereby obtaining a fresh water to be received by the fresh water pan 841. The fresh water pan 841 is connected through a pipe 844 such as a flexible hose to a fresh water tank 85. Accordingly, the fresh water is sent from the fresh water pan 841 through the pipe 844 to the fresh water tank 85 and stored in the fresh water tank 85.

The fresh water sent from the fresh water pan 841 through the pipe 844 to the fresh water tank 85 and stored in the fresh water tank 85 is next sent by a fresh water pump 850 through a pipe 851 such as a flexible hose to a ceramic filter 86 and next passed through ultraviolet light applying means 87, ion exchanging means 88, and an ultrafilter 89, thereby purifying the fresh water. The ceramic filter 86 functions to remove a minute substance contained in the fresh water sent by the fresh water pump 850. The ultraviolet light applying means 87 functions to apply ultraviolet light to the fresh water sent from the ceramic filter 86, thereby sterilizing the fresh water. The ion exchanging means 88 functions to perform ion exchange for the fresh water sent from the ultraviolet light applying means 87, thereby obtaining a pure water.

There is a case that the pure water sent from the ion exchanging means 88 may contain a minute substance such as resin dust due to an ion exchange resin constituting the ion exchanging means 88. Accordingly, the pure water sent from the ion exchanging means 88 is next introduced into the ultrafilter 89 to remove the minute substance such as resin dust due to the ion exchange resin contained in the pure water. Thereafter, the pure water is sent from the ultrafilter 89 to a pure water tank 90 as a common water source for the grinding water and the cleaning water and then stored in this pure water tank 90. The pure water tank 90 is connected to the grinding water supplying means 53 and the cleaning water supplying means 73.

The operation of the grinding apparatus configured above will now be described. First, the cassette 10 storing the wafer W as shown in FIG. 3B is set on the lid periphery support member 251 of the lid removing means 25 provided on the wafer load/unload table 22 of the unit housing 2 shown in FIG. 1 in such a manner that the periphery of the lid 120 of the cassette 10 is placed on the support step 251*b* of the lid periphery support member 251. Thereafter, the pressing unit 252 is operated to press the lid 120 against the support step 251*b* of the lid periphery support member 251. At this time, the cassette table elevating means 24 is operated to raise the cassette table 23 to the position where the upper end portion of the cassette table 23 comes into engagement with the opening 251*a* of the lid periphery support member 251 as shown in FIGS. 2 and 6A. Accordingly, the upper surface of the cassette table 23 comes into contact with the lower surface of the container 110 of the cassette 10.

In this condition, the lower surfaces of the ferromagnetic pins 111*b* mounted in the container 110 of the cassette 10 come into magnetic attachment to the upper surfaces of the second permanent magnets 231*c* provided in the cassette table 23 as shown in FIG. 6A. Thereafter, the cassette table elevating means 24 is operated to lower the cassette table 23 by a predetermined amount. As a result, the ferromagnetic pins 111*b* mounted in the container 110 are separated from the first permanent magnets 121*b* mounted in the lid 120 for the reason mentioned above, and only the container 110 is lowered together with the cassette table 23 to a predetermined position in the condition where the ferromagnetic pins 111*b* are magnetically attached to the second permanent magnets 231*c* provided in the cassette table 23. On the other hand, the lid 120 of the cassette 10 is held by the pressing unit 252 so as to close the opening 251*a* of the lid periphery support member 251. Accordingly, the inside of the unit housing 2 remains shielded from the outside air.

Thereafter, the wafer transfer means 26 is operated to transfer the wafer W placed on the support members 112*a* of the container 110 supported to the cassette table 23, to the temporary setting table 27 set at the wafer receiving position as shown in FIGS. 8 and 9. Thereafter, the wafer inverting means 28 is operated to 180° rotate the temporary setting table 27 to the inverted position as shown by the phantom line in FIG. 7. As a result, the wafer W held under suction on the support members 272 of the temporary setting table 27 is positioned directly above the chuck table 31 set in the wafer standby area shown in FIG. 2 in the condition where the front side of the wafer W is oriented downward.

Thereafter, the air cylinder 29 is operated to lower the wafer inverting means 28 and the temporary setting table 27 until the front side (lower surface) of the wafer W held on the temporary setting table 27 under suction comes into contact with the upper surface of the chuck table 31. In this condition, the suction holding by the support members 272 of the temporary setting table 27 is canceled to place the wafer W on the chuck table 31. Thereafter, the suction means (not shown) connected to the chuck table 31 is operated to hold the wafer W on the chuck table 31 under suction. Accordingly, the wafer W is held on the chuck table 31 in the condition where the back side of the wafer W is oriented upward.

After holding the wafer W on the chuck table 31 set in the wafer standby area as mentioned above, the chuck table moving means 32 is operated to move the chuck table 31 holding the wafer W to the thickness detection area where the thickness detecting means 6 is located. In this condition, the thickness detecting means 6 is operated to measure the thickness of the wafer W held on the chuck table 31 before grinding (the height of the upper surface of the chuck table 31 is preliminarily measured, so that the thickness of the wafer W can be detected by measuring the height of the upper surface of the wafer W). Thereafter, the chuck table 31 is moved to the grinding area where the grinding means 4 is located. In this condition, the servo motor 46 of the grinding means 4 is operated to rotate the grinding wheel 44, and the feeding means 47 is operated to lower the grinding wheel 44 until the abrasive members 442 come into contact with the wafer W, thereby grinding the back side (upper surface) of the wafer W held on the chuck table 31 (grinding step). This grinding condition is shown in FIG. 12, and the grinding water is sprayed from the grinding water nozzle 531 toward the abrasive members 442 opposed thereto as shown in FIG. 12. The grinding water sprayed against the abrasive members 442 in the grinding step is received as a waste water containing sludge by the waste water pan 52.

After performing the grinding step to grind the wafer W for a predetermined period of time, the chuck table moving means 32 is operated again to move the chuck table 31 holding the wafer W to the thickness detection area where the thickness detecting means 6 is located. Thereafter, the thickness detecting means 6 is operated to measure the thickness of the wafer W held on the chuck table 31 after grinding. When the thickness of the wafer W falls within a predetermined range at this time, the chuck table moving means 32 is operated to move the chuck table 31 holding the wafer W to the cleaning area where the cleaning means 7 is located. When the thickness of the wafer W falls above the predetermined range at this time, the grinding step is performed again.

After setting the chuck table 31 holding the wafer W in the cleaning area as mentioned above, the cleaning means 7 is operated to clean the wafer W. First, the air cylinder 72 is operated to lower the dome member 71, thereby covering the wafer W held on the chuck table 31 as shown in FIG. 13. In this condition, the cleaning water supplying means 73 and the air supplying means 74 are operated to spray the mixture of a cleaning water and air as two fluids from the cleaning water nozzle 715 toward the wafer W held on the chuck table 31 after grinding (cleaning step). Thereafter, the operation of the cleaning water supplying means 73 is stopped and only the air supplying means 74 remains operated to spray only the air from the cleaning water nozzle 715 toward the wafer W cleaned, thereby drying the wafer W (drying step).

After performing the cleaning step and the drying step for the wafer W ground as mentioned above, the chuck table moving means 32 is operated to move the chuck table 31 holding the wafer W to the wafer standby area. Thereafter, the wafer inverting means 28 is operated to set the temporary setting table 27 at the inverted position shown by the phantom line in FIG. 7. As a result, the temporary setting table 27 is positioned directly above the wafer W held on the chuck table 31 set in the wafer standby area after grinding. Thereafter, the air cylinder 29 is operated to lower the wafer inverting means 28 and the temporary setting table 27 until the support members 272 of the temporary setting table 27 come into contact with the back side (upper surface) of the wafer W held on the chuck table 31. In this condition, the suction holding by the chuck table 31 is canceled and the suction means (not shown) connected to the temporary setting table 27 is operated to hold the wafer W under suction after grinding. Thereafter, the wafer inverting means 28 is operated to 180° rotate the temporary setting table 27 holding the wafer W to the wafer receiving position shown by the solid line in FIG. 7.

Figure 15A:
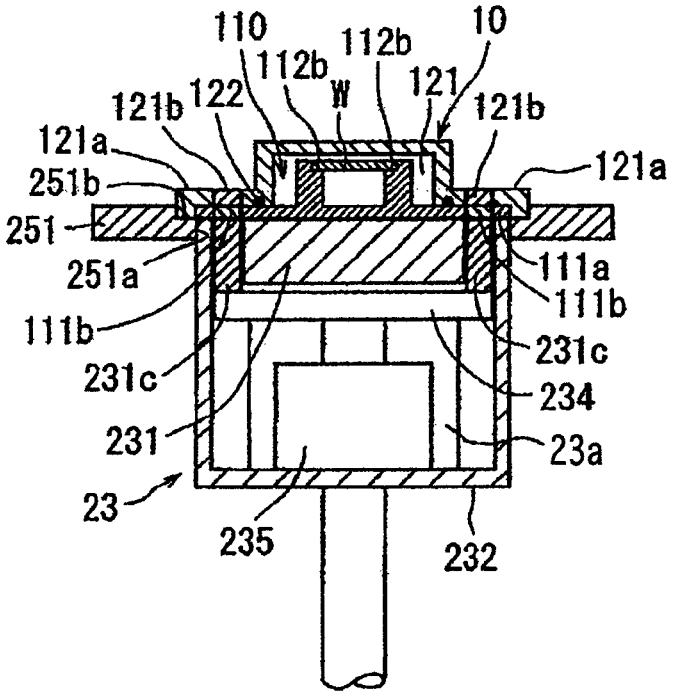
FIGS. 15A and 15B are partially sectional side views for illustrating the operation of an air cylinder provided in a storing chamber defined in the cassette table.

Thereafter, the suction holding by the temporary setting table 27 is canceled and the wafer transfer means 26 is operated to transfer the wafer W from the temporary setting table 27 to the support members 112*a* formed on the bottom plate 111 of the container 110 left on the cassette table 23. Thereafter, the cassette table elevating means 24 is operated to raise the cassette table 23 until the upper surface of the bottom plate 111 of the container 110 held on the upper surface of the cassette table 23 comes into contact with the lower surface of the lid 120 held on the lid periphery support member 251 as shown in FIG. 15A. As a result, the upper surface of the ferromagnetic pins 111*b* mounted in the container 110 come into magnetic attachment to the lower surfaces of the first permanent magnets 121*b* mounted in the lid 120.

Figure 15B:
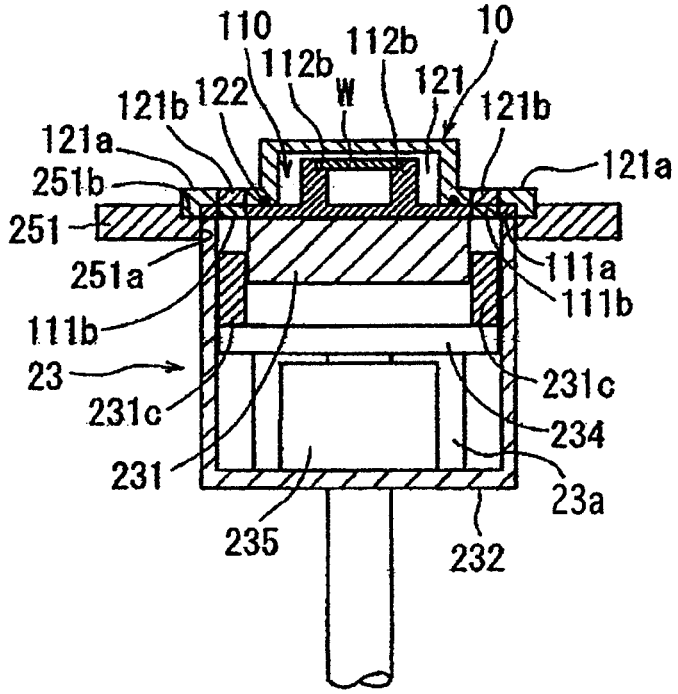

Thereafter, as shown in FIG. 15B, the air cylinder 235 provided in the storing chamber 23*a* of the cassette table 23 is operated to lower the support plate 234, thereby lowering the second permanent magnets 231*c* to the retracted position where the upper ends of the second permanent magnets 231*c* are retracted downward from the upper surface of the top wall 231. At this time, the ferromagnetic pins 111*b* mounted in the container 110 held on the cassette table 23 remain magnetically attached to the first permanent magnets 121*b* mounted in the lid 120, thereby maintaining the sealed condition of the cassette 10 storing the wafer W. Thereafter, the pressure applied to the lid 120 by the pressing unit 252 pressing the support step 251*b* of the lid periphery support member 251 is removed to allow easy removal of the cassette 10 storing the wafer W from the lid periphery support member 251 in the sealed condition of the cassette 10. In the grinding apparatus described above, the wafer W having a small diameter can be efficiently ground to reduce the thickness of the wafer W to a desired thickness.

While a specific preferred embodiment of the present invention has been described with reference to the drawings, the present invention is not limited to the above preferred embodiment, but various modifications may be made within the scope of the present invention. For example, while the grinding apparatus in the above preferred embodiment includes the pure water generating means 8 for purifying the waste water collected by the waste water collecting means 5 and returning the resultant pure water to the pure water tank 90, the waste water collected by the waste water collecting means 5 may be discarded.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding apparatus for grinding a wafer stored in a cassette composed of a container for storing said wafer and a lid for enclosing said container, said grinding apparatus comprising:

a cassette table for placing said cassette thereon;

lid removing means for removing said lid from said cassette placed on said cassette table and leaving only said container on said cassette table;

cassette table elevating means for vertically moving said cassette table;

wafer transfer means for transferring said wafer from said container left on said cassette table lowered by said cassette table elevating means;

a temporary setting table for temporarily setting said wafer transferred by said wafer transfer means;

wafer inverting means for inverting said wafer temporarily set on said temporary setting table;

a chuck table for receiving said wafer inverted by said wafer inverting means in a wafer standby area and holding said wafer under suction;

chuck table moving means for moving said chuck table from said wafer standby area to a grinding area;

grinding means provided in said grinding area for grinding said wafer held on said chuck table, said grinding means having a grinding wheel composed of a wheel base and a plurality of abrasive members annularly mounted on said wheel base;

grinding water supplying means having a water source for supplying a grinding water to said abrasive members of said grinding wheel;

waste water collecting means for collecting waste water generated in grinding said wafer by operating said grinding means as supplying said grinding water by operating said grinding water supplying means; and cleaning means for cleaning said wafer held on said chuck table after grinding.

2. The grinding apparatus according to claim 1, wherein said cleaning means includes a dome for covering said wafer held on said chuck table, dome elevating means for vertically moving said dome, and a cleaning water nozzle provided inside said dome for spraying cleaning water toward said wafer.

3. The grinding apparatus according to claim 2, further comprising:

cleaning water supplying means having a water source for supplying said cleaning water to said cleaning means and air supplying means having an air source for supplying air to said cleaning means, wherein said cleaning water supplied by said cleaning water supplying means is mixed with said air supplied by said air supplying means to form a two-fluid mixture, which is sprayed from said cleaning water nozzle.

4. The grinding apparatus according to claim 3, wherein after cleaning said wafer held on said chuck table, said cleaning means functions to dry said wafer by stopping the operation of said cleaning water supplying means and operating only said air supplying means to thereby spray only said air from said cleaning water nozzle toward said wafer.

5. The grinding apparatus according to claim 3, wherein said water source of said grinding water supplying means and said water source of said cleaning water supplying means are provided by a common water tank;

said grinding apparatus further comprising pure water generating means for purifying said waste water collected by said waste water collecting means to generate a pure water and then returning said pure water to said water tank.

6. The grinding apparatus according to claim 5, wherein said pure water generating means includes a filter for filtering said waste water to generate fresh water, a ceramic filter for filtering said fresh water, ultraviolet light applying means for sterilizing said fresh water filtered by said ceramic filter, an ion exchange resin for removing ions from said fresh water sterilized by said ultraviolet light applying means to thereby generate almost pure water, and an ultrafilter for filtering said almost pure water to obtain said pure water, which is then returned to said water tank.

7. The grinding apparatus according to claim 1, wherein said grinding water supplying means includes a grinding water nozzle provided adjacent to said chuck table set in said grinding area for spraying said grinding water toward said abrasive members at a position spaced apart from said wafer held on said chuck table.

8. The grinding apparatus according to claim 1, wherein said grinding means includes a spindle, a motor for rotationally driving said spindle, a housing for rotatably supporting said spindle, a mounter mounted to said spindle for mounting said grinding wheel thereon, a fastening nut for fixing said grinding wheel to said mounter, and chuck means for mounting said mounter to said spindle;

said mounter including a flange portion having an upper surface to be mounted to said spindle and a lower surface for supporting said wheel base of said grinding wheel, a boss portion projecting from the lower surface of said flange portion at its central portion, said boss portion having an external thread on the outer circumference and being insertable through an opening formed at a central portion of said wheel base, and a shank projecting from the upper surface of said flange portion at its central portion;

whereby said boss portion of said mounter is inserted through said opening of said wheel base, and said fastening nut is next threadedly engaged with said external thread of said boss portion to thereby fix said wheel base to the lower surface of said flange portion of said mounter, and said shank of said mounter is next chucked by said chuck means to thereby mount said mounter to said spindle.

9. The grinding apparatus according to claim 1, further comprising:

thickness detecting means for detecting the thickness of said wafer held on said chuck table.

10. The grinding apparatus according to claim 1, wherein said lid of said cassette is provided with a first magnet, and said container of said cassette is provided with a ferromagnetic member adapted to be magnetically attached to said first magnet, whereby said first magnet is magnetically attached to said ferromagnetic member to thereby define an enclosed space in said cassette shielded from the outside air;

said lid removing means including a lid periphery support member for supporting the periphery of said lid so as to surround the upper portion of said cassette table raised by said cassette table elevating means, a pressing unit for pressing said lid of said cassette placed on said cassette table, and a second magnet provided in said cassette table so as to be retractable from the upper surface of said cassette table for magnetically attracting said ferromagnetic member provided in said container of said cassette, said second magnet having a magnetic force larger than that of said first magnet;

whereby when said cassette table is lowered by said cassette table elevating means, said ferromagnetic member provided in said container of said cassette placed on said cassette table is separated from said first magnet provided in said lid, and said container is lowered together with said cassette table by the magnetic attachment of said ferromagnetic member to said second magnet, so that said lid is left on said lid periphery support member and thereby removed from said cassette.

* * * * *